US009258637B2

(12) United States Patent
Wu et al.

(10) Patent No.: US 9,258,637 B2
(45) Date of Patent: Feb. 9, 2016

(54) EARPHONE SOCKET HAVING RF CONNECTOR DEVICE

(71) Applicant: Aliner Industries Inc., Taipei (TW)

(72) Inventors: Meng Chieh Wu, Taipei (TW); Chung Ta Yang, Taipei (TW)

(73) Assignee: Aliner Industries Inc., Taipei (TW)

( * ) Notice: Subject to any disclaimer, the term of this patent is extended or adjusted under 35 U.S.C. 154(b) by 233 days.

(21) Appl. No.: 13/971,960

(22) Filed: Aug. 21, 2013

(65) Prior Publication Data

US 2015/0055791 A1 Feb. 26, 2015

(51) Int. Cl.

| | |
|---|---|
| ***H04R 1/10*** | (2006.01) |
| ***H01R 24/00*** | (2011.01) |
| ***H01R 24/58*** | (2011.01) |
| *H01R 13/02* | (2006.01) |
| *H04R 3/00* | (2006.01) |

(52) U.S. Cl.

CPC ..... *H04R 1/1091* (2013.01); *H01R 24/58* (2013.01); *H01R 13/02* (2013.01); *H04R 3/00* (2013.01); *H04R 2420/07* (2013.01); *H04R 2460/07* (2013.01)

(58) Field of Classification Search

None

See application file for complete search history.

(56) References Cited

U.S. PATENT DOCUMENTS

| | | | | |
|---|---|---|---|---|
| 6,688,918 | B2 | 2/2004 | Wang et al. | |
| 6,928,310 | B2 | 8/2005 | Lee | |
| 7,340,284 | B2 | 3/2008 | Chung | |
| 7,940,339 | B2 | 5/2011 | Horiuchi | |
| 2006/0028383 | A1 * | 2/2006 | Yoshino | 343/718 |
| 2006/0148314 | A1 * | 7/2006 | Castaneda et al. | 439/581 |
| 2011/0237110 | A1 * | 9/2011 | Montena | 439/349 |
| 2012/0144072 | A1 * | 6/2012 | Hansson et al. | 710/15 |

* cited by examiner

*Primary Examiner* — Andrew L Sniezek

(74) *Attorney, Agent, or Firm* — Charles E. Baxley

(57) ABSTRACT

An electrical facility includes an earphone socket having a housing which includes a socket opening at one end portion and a compartment in the other end portion and which includes one or more signal terminals and a ground terminal, and a connector mechanism is engaged in the compartment of the housing and includes a socket element directed toward and aligned with the socket opening of the housing, and includes an output terminal electrically connected to the socket element. The connector mechanism may be selected from an RF connector mechanism. The output terminal of the housing is directed toward an outer peripheral portion of the housing.

5 Claims, 4 Drawing Sheets

EARPHONE SOCKET HAVING RF CONNECTOR DEVICE

BACKGROUND OF THE INVENTION

1. Field of the Invention

The present invention relates to an earphone socket or jack, and more particularly to an earphone socket including a radio frequency (RF) connector device for transmitting radio frequency signals in addition to the radio and/or vocal and/or audio signals.

2. Description of the Prior Art

Typical earphone sockets comprise a phone connector or audio connector including a phone jack or socket having a 3.5 mm socket opening formed or provided therein for plugging or receiving or engaging with the corresponding 3.5 mm phone plug or the like, in which the typical phone jack or socket is normally disposed or attached or mounted or secured in an electrical facility or apparatus, such as the mobile phone or portable phone, and normally includes a radio or audio module for AM/FM single receiving and/or transmitting purposes, compact disc processing purposes, MP3 processing purposes, or the like, and the phone plug is normally electrically connected or coupled to the earphone or the speaker or the like for outputting the radio or audio signals.

For example, U.S. Pat. No. 6,688,918 to Wang et al., U.S. Pat. No. 6,928,310 to Lee, U.S. Pat. No. 7,340,284 to Chung, and U.S. Pat. No. 7,940,339 to Horiachi disclose several of the typical electrical facilities or apparatuses comprising a phone plug for selectively engaging with the phone jack or socket of the electrical facility or apparatus.

However, the phone jacks or sockets and the phone plugs of the electrical facilities or apparatuses may be used for receiving and/or transmitting the radio or audio signals of relatively lower frequencies, and may not be used for receiving and/or transmitting the radio frequency (RF) signals of relatively higher or greater frequencies, such that an additional phone jack or socket and/or phone plug is further required be provided for receiving and/or transmitting the radio frequency (RF) signals of relatively higher or greater frequencies.

Furthermore, the radio frequency (RF) signals processing modules, such as Global Positioning System (GPS) modules, WiFi modules, digital video broadcasting terrestrial (DVB-T) modules, digital audio broadcasting modules, etc. have now been widely used for receiving and/or transmitting and/or processing the radio frequency (RF) signals which may not be used for receiving and/or transmitting the radio frequency (RF) signals of relatively higher or greater frequencies.

The present invention has arisen to mitigate and/or obviate the afore-described disadvantages of the conventional earphone sockets and/or phone plugs of the typical electrical facilities or apparatuses.

SUMMARY OF THE INVENTION

The primary objective of the present invention is to provide an earphone socket including a radio frequency (RF) connector device for transmitting radio frequency signals in addition to the radio and/or vocal and/or audio signals.

In accordance with one aspect of the invention, there is provided an electrical facility comprising an earphone socket including a housing having a socket opening formed in a first end portion of the housing, and having a compartment formed in a second end portion of the housing, and having at least one signal terminal and a ground terminal provided on the housing, and a connector mechanism engaged in the compartment that is formed in the second end portion of the housing, and the connector mechanism including a socket element disposed and directed toward and aligned with the socket opening of the housing, and including an output terminal electrically connected to the socket element for electrically connecting to the electrical facility.

The socket opening of the housing includes an inner diameter which may be selected from 2.5 mm, 3.5 mm, or 6.35 mm for selectively engaging with the plug members of different outer diameter. The housing includes at least one second signal terminal for providing a stereo function for the earphone socket and/or for single receiving and/or transmitting purposes.

The connector mechanism may be formed integral with the housing as a one integral piece, or may be engaged into the compartment of the housing and secured to the housing. The connector mechanism may be selected from an RF connector mechanism for radio frequency single receiving and/or transmitting purposes.

The output terminal of the housing is faced outwardly or directed toward an outer peripheral portion of the housing. The socket element of the housing is aligned with and concentric with the socket opening of the housing.

A phone plug may further be provided and includes a male plug member for engaging with the socket opening of the housing, and an RF cable engaged in the male plug member for electrically and selectively connecting to the socket element of the connector mechanism and for radio frequency single receiving and/or transmitting purposes.

An electric circuit board may further be provided and includes a radio frequency signal processing module disposed on the electric circuit board and electrically connected to the output terminal of the connector mechanism. The signal terminal and the ground terminal of the housing are electrically connected to the electric circuit board.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
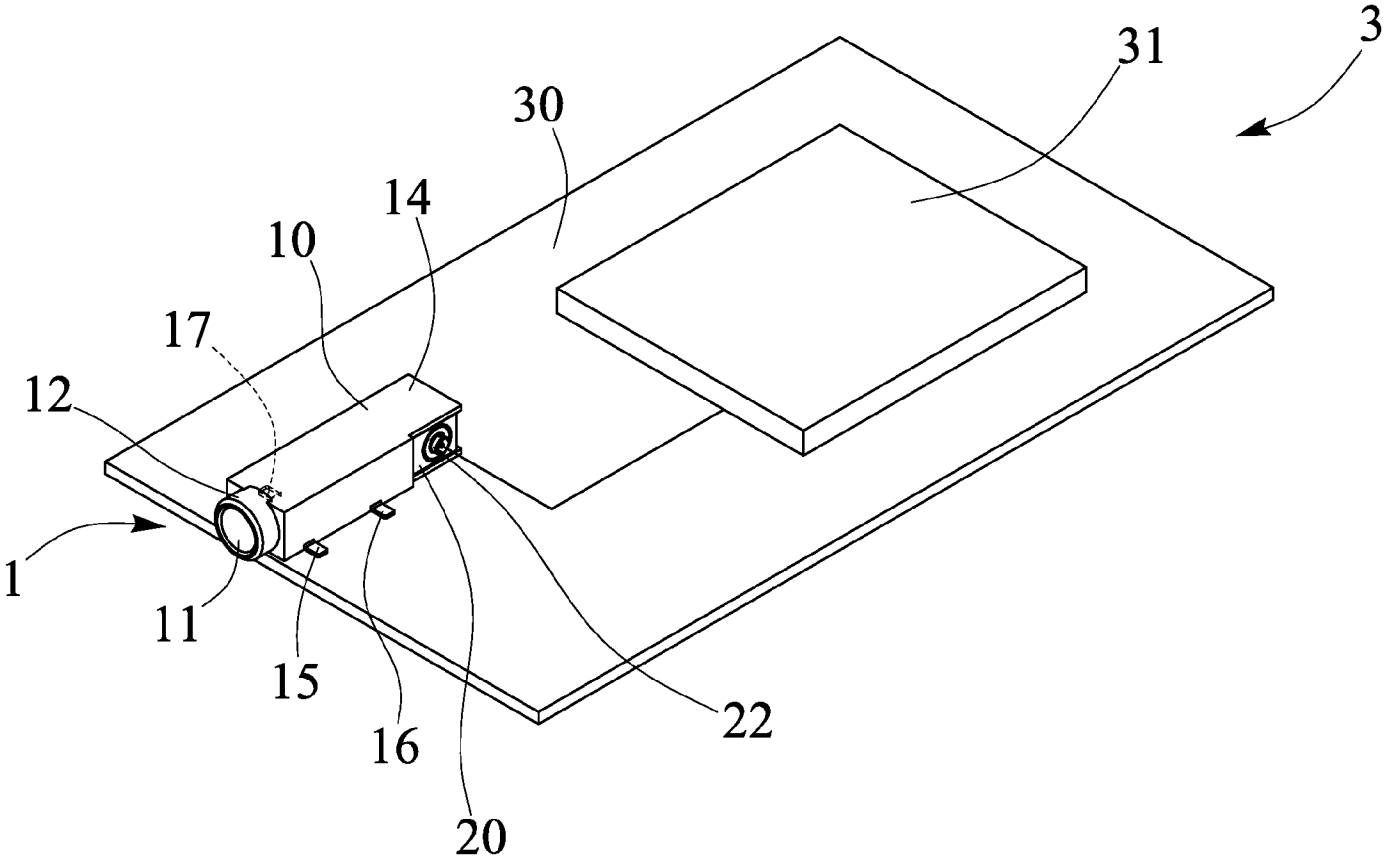
FIG. 1 is a perspective view of an earphone socket for an electrical facility or apparatus in accordance with the present invention.

Referring to the drawings, and initially to FIG. 1, an earphone socket 1 in accordance with the present invention is provided for attaching or mounting or securing to an electric circuit board 30 of an electrical facility or apparatus 3, such as the mobile phone or portable phone or the like, and the electrical facility or apparatus 3 includes a radio frequency (RF) signals processing module 31, such as Global Positioning System (GPS) module, WiFi module, digital video broadcasting terrestrial (DVB-T) module, digital audio broadcasting module, etc., disposed or attached or mounted or secured on the electric circuit board 30. The earphone socket 1 includes a receptacle or body member or housing 10 also disposed or attached or mounted or secured on the electric circuit board 30 and to be electrically connected or coupled to the RF signals processing module 31.

Figure 2:
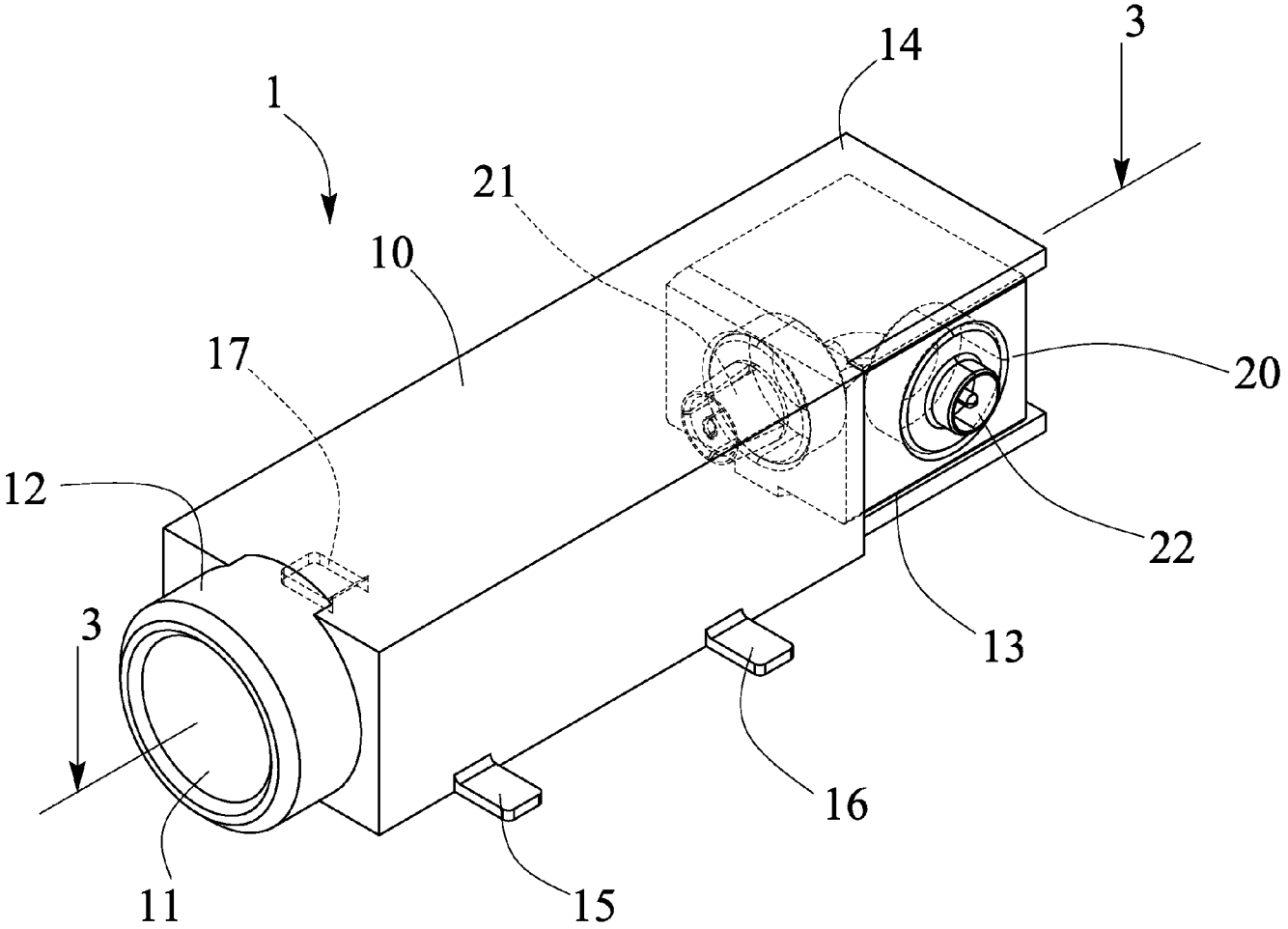
FIG. 2 is a perspective view of the earphone socket for the electrical facility or apparatus.
Figure 3:
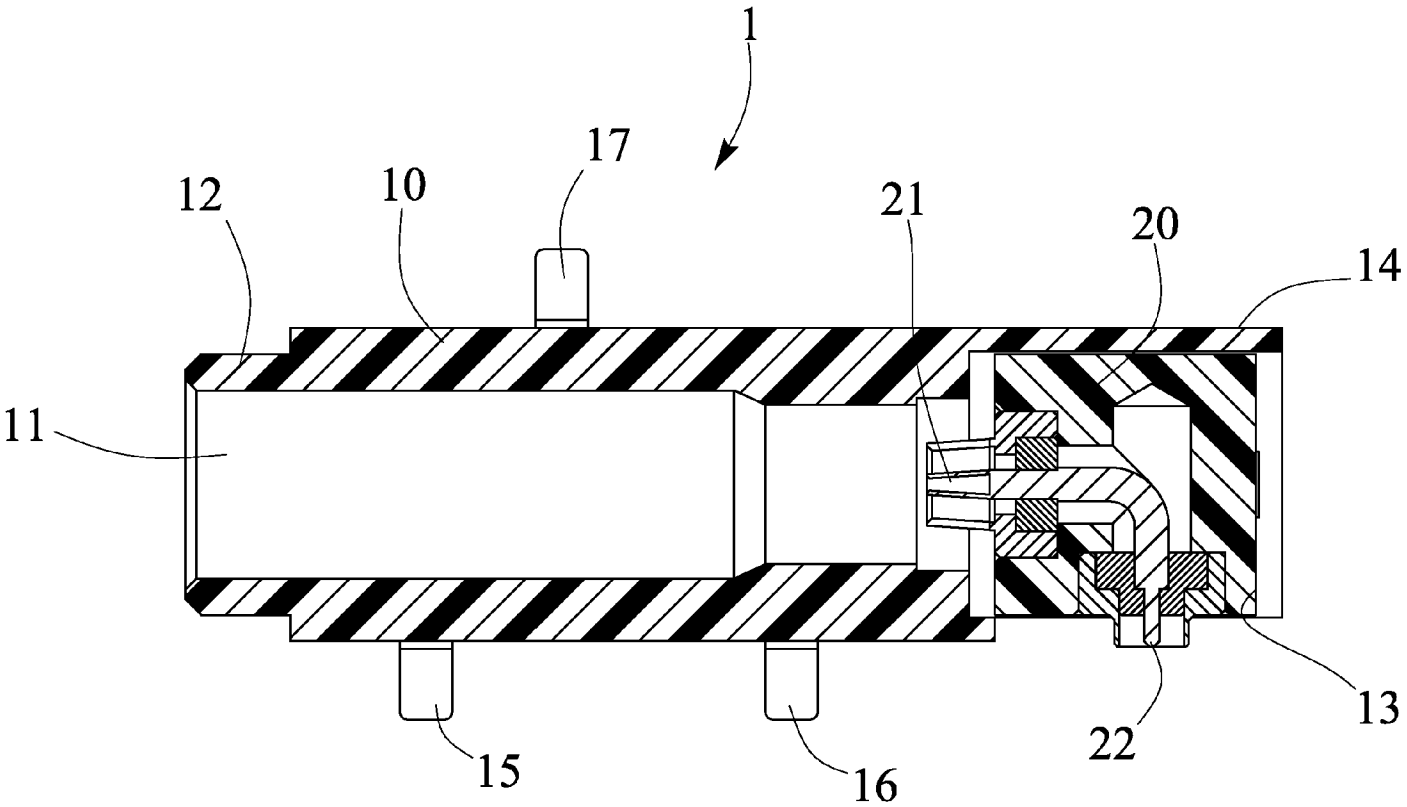
FIG. 3 is a cross sectional view of the earphone socket, taken along lines 3-3 of FIG. 2.

For example, as shown in FIGS. 2 and 3, the housing 10 includes a socket cavity or opening 11 formed or provided in one end or first end portion 12 thereof and having an inner diameter selected from 2.5 mm, 3.5 mm, 6.35 mm for receiving or engaging with the corresponding phone plug 5 (FIG. 4) or the like, and includes a chamber or compartment 13 formed therein, such as formed in the other or second end portion 14 thereof for receiving or engaging with a connector body member or connector device or mechanism 20 or the like, and the housing 10 includes one or more (such as two) signal electrodes or terminals 15, 16, and a ground electrode or terminal 17 for electrically and selectively connecting or coupling to the electric circuit board 30 of the electrical facility or apparatus 3, in which the signal electrodes or terminals 15, 16 may be used for providing the stereo function for the earphone socket 1 and/or for radio or audio or video single receiving and/or transmitting purposes.

Figure 4:
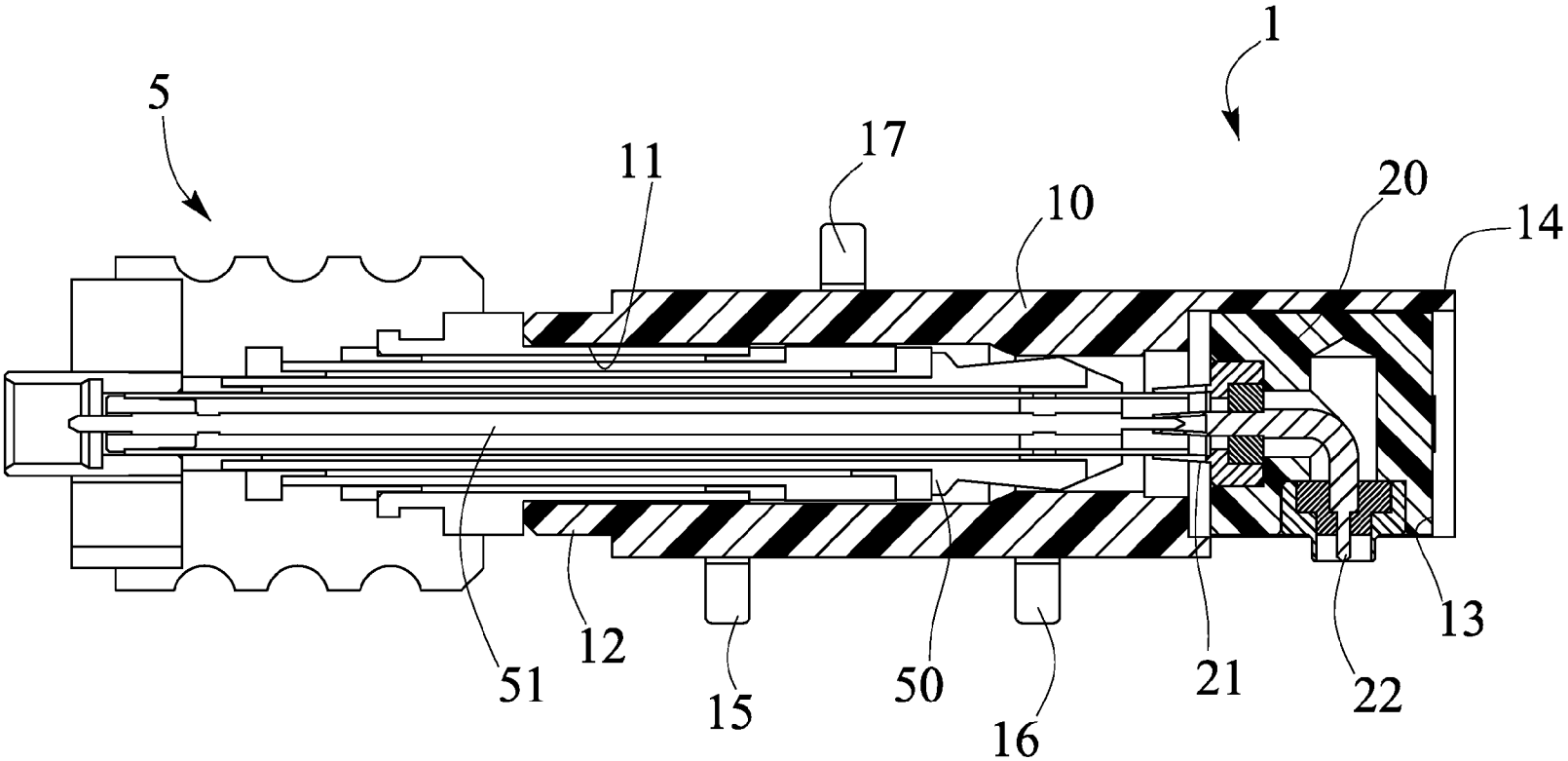
FIG. 4 is another cross sectional view similar to FIG. 3, illustrating the operation of the earphone socket for the electrical facility or apparatus.

The connector mechanism 20 includes a contact or electrode or terminal or socket element 21 disposed or located or faced or directed toward or aligned with or engaged into or with, and concentric with the socket opening 11 of the housing 10, and another contact or electrode or terminal or socket member or output terminal 22 electrically connected or coupled to the socket element 21, and the output terminal 22 is extended or located or faced or directed out or away from the housing 10, or provided on the outer peripheral portion of the housing 10 and electrically connected or coupled to the RF signals processing module 31 (FIG. 1). As shown in FIG. 4, the phone plug 5 includes a male plug body element or member 50 for engaging with or into the socket opening 11 of the housing 10, and an RF signal wire or cable 51 disposed or located or engaged in the male plug member 50 for electrically and selectively connecting or coupling or engaging with the socket element 21 of the connector mechanism 20 and for RF single receiving and/or transmitting purposes.

In operation, as shown in FIGS. 1 and 4, the male plug member 50 of the phone plug 5 may be selectively engaged with or into the socket opening 11 of the housing 10 for receiving and/or transmitting the radio or audio signals of relatively lower frequencies, and the RF signal cable 51 may be selectively engaged with or into the socket element 21 of the connector mechanism 20 for receiving and/or transmitting the radio frequency (RF) signals of relatively higher or greater frequencies. The connector mechanism 20 may be disposed or engaged into the compartment 13 of the housing 10 and connected or coupled or secured or welded to the housing 10, or the connector mechanism 20 may be formed integral with the housing 10 as a one integral piece.

Accordingly, the earphone socket in accordance with the present invention includes a radio frequency (RF) connector device for transmitting radio frequency signals in addition to the radio and/or vocal and/or audio signals.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

We claim:

1. An electrical facility comprising:

an earphone socket including a housing having a socket opening formed in a first end portion of said housing, and having a compartment formed in a second end portion of said housing, and having at least one signal terminal and a ground terminal provided on said housing, a radio frequency (RF) connector mechanism engaged in said compartment that is formed in said second end portion of said housing, and said connector mechanism including a socket element disposed and directed toward and aligned with said socket opening of said housing, and concentric with said socket opening of said housing, and including an output terminal electrically connected to said socket element, a phone plug including a male plug member for engaging with said socket opening of said housing, a radio frequency (RF) cable engaged in said male plug member for electrically connecting to said socket element of said connector mechanism, and an electric circuit board including a radio frequency signal processing module disposed on said electric circuit board and electrically connected to said output terminal of said connector mechanism, said at least one signal terminal and said ground terminal of said housing being electrically connected to said electric circuit board.

2. The electrical facility as claimed in claim 1, wherein said socket opening of said housing includes an inner diameter selected from 2.5 mm, 3.5 mm, or 6.35 mm.

3. The electrical facility as claimed in claim 1, wherein said housing includes at least one second signal terminal.

4. The electrical facility as claimed in claim 1, wherein said connector mechanism is formed integral with said housing as a one integral piece.

5. The electrical facility as claimed in claim 1, wherein said output terminal of said housing is directed toward an outer peripheral portion of said housing.

* * * * *